United States Patent [19]

Okada et al.

[11] Patent Number: 4,489,630

[45] Date of Patent: Dec. 25, 1984

[54] METHOD AND APPARATUS FOR SLITTING THERMOPLASTIC FILMS

[75] Inventors: Tokio Okada; Shigezo Kojima; Haruhisa Tani; Kazuhiko Kurihara, all of Tokyo; Hirosi Yazawa, Kunitachi, all of Japan

[73] Assignees: Nippon Petrochemicals Co Ltd., Chiyoda; Polymer Processing Research Institute Ltd., Tokyo, both of Japan

[21] Appl. No.: 419,563

[22] Filed: Sep. 17, 1982

[30] Foreign Application Priority Data

Sep. 21, 1981 [JP] Japan ..... 56-148967

[51] Int. Cl.[3] ..... B26F 3/10; B26D 7/10

[52] U.S. Cl. ..... 83/15; 83/170; 83/171; 83/16

[58] Field of Search ..... 83/15, 171, 16, 175, 83/170, 508, 660

[56] References Cited

U.S. PATENT DOCUMENTS 4,051,754 10/1977 Harcûba et al. ..... 83/171 X
4,069,727 1/1978 Sparks et al. ..... 83/171 X
4,098,159 7/1978 Rothfuss ..... 83/171
4,123,954 11/1978 Koldsov ..... 83/171
4,161,898 7/1979 Wingen ..... 83/171
4,279,183 7/1981 Lafleur ..... 83/171 X

*Primary Examiner*—Donald R. Schran
*Attorney, Agent, or Firm*—Bucknam and Archer

[57] ABSTRACT

A method of slitting a continuous thermoplastic film comprises advancing the film longitudinally at a first speed along a peripheral surface of a roll rotating at a peripheral speed equal to or slightly greater than that of the film, and slitting the film while being advanced by pressing cutting edges of a rotating cutter against the peripheral surface of the roll. In order to prevent the cutting edges from being worn out and to form slits of uniform size and shape, the peripheral surface comprises an elastic layer of polymeric material, the cutting edges are heated above a temperature at which the film starts melting, the film and the elastic surface layer are cooled along their contacting surfaces with a cooling liquid, and the cutting edges are rotated at substantially the same peripheral speed as the roll. The invention also includes an apparatus for carrying out the method.

27 Claims, 3 Drawing Figures

METHOD AND APPARATUS FOR SLITTING THERMOPLASTIC FILMS

BACKGROUND OF THE INVENTION

1. Field of the Invention:

The present invention relates to a method of and an apparatus for providing a thermoplastic film with continuous or discrete slits extending in the longitudinal or transverse direction thereof.

2. Prior Art:

In the manufacture of reticular webs, a variety of methods and apparatus have been known for providing a thermoplastic film with continuous or discrete slits extending longitudinally or transversely between the opposite edges of the film before the film is stretched transversely or longitudinally into a reticular web.

Among such known apparatus, razor cut slitters and highspeed rotary cutters have been found to be disadvantageous in that their sharp cutting edges are liable to be worn out and become dull in a relatively short period of use when employed in slitting a non-stretched thermoplastic film, because the cutting edges undergo much abrasion by being forced along the film surface. With such worn-out or dull cutting edges, the film is locally stretched or sometimes cracked at portions adjacent to the slits formed, and hence is ruptured or torn apart at the defective slits as it is stretched into a reticular web. In a score cut slitter, circular cutting edges pressed against a hard peripheral surface of a roll are worn out at a rapid rate, moreover, the roll surface is liable to be damaged by the cutting edges. As shear cut slitters utilize a cooperating pair of bottom and top blades, a film is liable to be cracked at the ends of slits formed with the blades. Ordinary heat cut slitters have the drawback that slits formed with a hot blade are irregular in shape due to scratches made by cutting blades stained with fused film material sticking onto them, or are partly closed by rejoining.

SUMMARY OF THE INVENTION

According to the present invention, a continuous thermoplastic film is advanced at a first speed along a peripheral surface of a roll rotating at a circumferential speed substantially equal to or slightly greater than the first speed, the peripheral surface comprising an elastic layer of polymeric material. The film while being advanced along the elastic surface layer is slitted by being only slightly pressed with the cutting edges of a cutter against the elastic surface layer, the cutter engaged therewith rotating at substantially the same speed as the roll. The cutting edges are thus protected from abrasive wear, which would result from the cutting edges being dragged along the film as in prior art apparatus. The cutting edges are heated above a temperature at which the thermoplastic film starts melting so that they can penetrate the film with a minimum pressure. The interfacial regions of the film and the elastic surface layer are cooled with a liquid so that the slits formed in the film have a shape identical with the contour of the respective cutting edges, fused film material is prevented from sticking onto the cutting edges as top portions of the cutting edges are rapidly cooled upon their penetration through the film, and the elastic surface layer is registant to aging.

It is an object of the present invention to provide a method and apparatus which eliminate the foregoing drawbacks associated with those in the prior art.

A more specific object of the present invention is to provide a method of and an apparatus for slitting a non-stretched thermoplastic film which is suitable for use in the manufacture of a reticular web.

Another object of the present invention is to provide a method and apparatus which can form a number of slits of uniform size and shape in a non-stretched thermoplastic film as close as possible so as to enable the film to be stretched at an increased magnification of stretch into a fine reticular web.

A further object of the present invention is to provide a method of and an apparatus for slitting a thermoplastic film in which cutting means is protected from abrasive wear and hence is durable.

Many other advantages, features and additional objects of the present invention will become manifest to those versed in the art upon making reference to the detailed description and the accompanying drawings in which two preferred embodiments incorporating the principles of the present invention are shown by way of illustrative example.

DETAILED DESCRIPTION OF THE PREFERRED EMBODIMENTS

Figure 1:
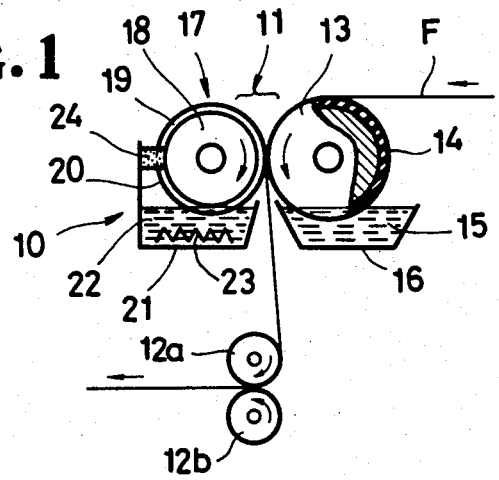
FIG. 1 is a diagrammatic front elevational view, partly in cross section, of an apparatus according to one embodiment of the present invention.
Figure 2:
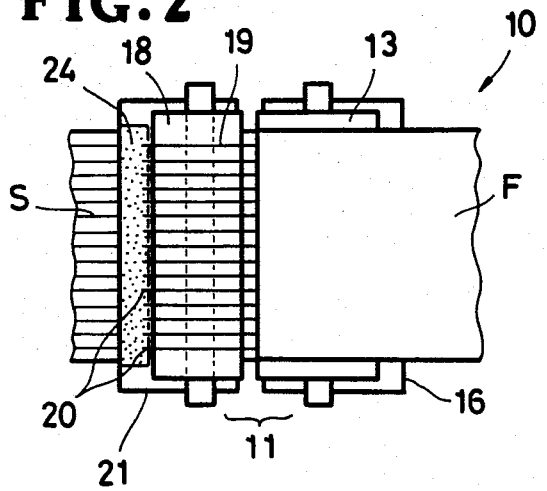
FIG. 2 is a plan view of the apparatus shown in FIG. 1.

FIGS. 1 and 2 show an apparatus 10 for providing a continuous thermoplastic film F with a number of continuous slits S extending longitudinally between the opposite edges of the film F. The apparatus 10 comprises a slitting unit 11 and a pair of pinch rollers 12*a*, 12*b* disposed downstream of the slitting unit 11 and rotatable in cooperation with each other to advance the film F from through the slitting unit 11 to a spreading apparatus for manufacturing a reticular web or to an appropriate storing means (neither shown).

The slitting unit 11 comprises a roll 13 rotatable about its own axis at a circumferential speed substantially equal to or slightly greater than the first speed or speed of feed of the film F. The roll 13 has a peripheral surface along which the film F is advanced as it is fed from an appropriate source (not shown). As shown in FIG. 1, the peripheral surface comprises an elastic layer 14 made of a polymeric material, which usually is an elastomer, but may also be resin-impregnated leather or fabric, and at times can be leather or fabric itself. Among these polymeric materials, elastomers such as, for example, soft synthetic rubbers are preferable as they are easy to manufacture and available in a variety of hardness.

The lower portion of the roll 13 is immersed in a colling liquid 15 such as water contained in a bath or container 16, or otherwise at least the elastic surface layer 14 is wetted with a cooling liquid 15 in a suitable way, so as to cool both the film F and the elastic surface 14 along their interface as the roll 13 rotates.

The slitting unit 11 further includes a cutter 17 disposed adjacent to the roll 13 and rotatable at substantially the same speed as the roll 13 in a direction opposite to that of the roll 13. The cutter 17 includes a cylindrical body 18 rotatable about its own axis, and a plurality of circular cutting blades 19 fixedly mounted on the body 18 for corotation therewith. The blades 19 are spaced one another at a predetermined interval in the axial direction of the body 18. Each of the blades 19 has a circular cutting edge 20 extending throughout the circumferential length thereof and adapted to be pressed against the elastic surface layer 14 of the roll 13 for providing the film F with a continuous slit S extending longitudinally of the film F as the film F is advanced continuously along the elastic surface layer 14. Although not shown, the blade 19 may be notched at circumferential intervals so as to form a series of discrete arcuate cutting edges extending along the circumference of the blade 19. Such cutting edge forms a series of discrete slits extending longitudinally of a film.

A bath or container 21 is disposed beneath the cutter 17 and contains a heating medium such as silicone oil 22 into which the cutting blades 19 are immersed as the cutter 17 rotates. A heating element 23 is provided in the bath 21 for heating and maintaining the silicone oil 22 at a temperature which is enough to heat the cutting edges 20 above a temperature at which the thermoplastic film starts melting. A sponge block 24 is disposed alongside the cutter 17 adjacent to the cutting blades 19 for scraping the silicone oil 22 off the cutting edges 20 before the latter slits the film F.

In operation, the film F is advanced along the elastic surface layer 14 of the rotating roll 13, and then taken off by the pinch rollers **12*a*, 12*b*. The cutting edges 20 of the rotating cutter 17, which are heated by the hot silicone oil 22 at the suitable temperature, are pressed against the elastic surface layer 14 to slit the film F as the film F is advanced along the elastic surface layer 14 while both the film F and the elastic surface layer 14 are cooled with water 15 carried therebetween. During that time, the tops of the cutting edges 20 thus heated first fuse only those portions of the film F against which they are pressed to penetrate therethrough with a minimum degree of pressure, then are cooled by water 15 carried on the elastic surface layer 14, and are again heated by the hot silicone oil 22** to the suitable temperature.

With the cutting edges 20 thus cooled, fused film material is prevented from sticking onto the cutting edges when they leave the film F. As the film F and the elastic surface layer 14 are cooled by water 15 along their contacting surface, the slits S are formed at only those spots where the heated cutting edges 20 contact and penetrate the film F, exactly in a shape complemental to the contour of the respective cutting edges 20, and the elastic surface layer 14 is resistant to aging under the influence of the heat from the cutting edges 20, remains elastic and, hence, is durable, although it may undergo some damage by the cutting edges 20. The cutting edges 20 are heated to a sufficiently elevated temperature to fuse and penetrate the film F when pressed on it with a minimum pressure and are rotated, while kept in engagement with the roll 13 with such minimum pressure, at substantially the same peripheral speed as the roll 13, without being forced along the surface either of the film F or of the roll 13. The cutting edges 20, therefore, unlike those in prior art slitting apparatus, undergo very little or no abrasive wear and have a prolonged life. With this arrangement, even when discrete slits are formed in a film, the resulted film is free of cracks at the ends of the respective slits.

Figure 3:
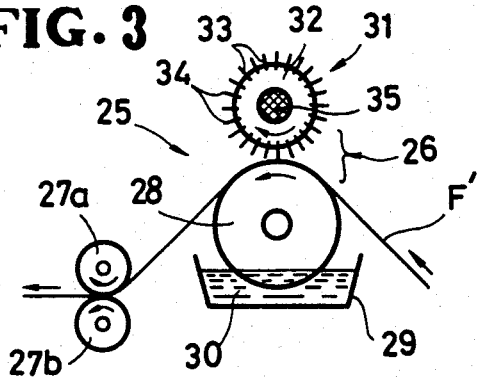
FIG. 3 is a diagrammatic front elevational view, partly in cross section, of an apparatus according to another embodiment of the present invention.

According to another embodiment of the invention shown in FIG. 3, an apparatus 25 is constructed to provide a film F' with continuous or discrete slits (not shown) extending transversely between the opposite edges of the film F'. The apparatus 25 comprises a slitting unit 26 and a pair of pinch rollers **27*a*, 27*b* disposed downstream of the slitting unit 26 for the same purpose as the ones 12*a*, 12*b* of the foregoing embodiment shown in FIGS. 1 and 2. The slitting unit 26 includes a roll 28 immersed at its lower portion in a bath 29 for a coolant 30. Both the roll 28 and the bath 30 are the same in construction and function as the corresponding ones 13,16** of the foregoing embodiment, and no detailed discussion thereabout is needed.

The slitting unit 26 further comprises a cutter 31 disposed adjacent to the roll 28 and rotatable substantially at the same speed as the roll 28. The cutter 31 includes a hollow cylindrical body 32 rotatable about its own axis, and a plurality of rectangular cutting blades 33 mounted on the body 32 for corotation therewith. The blades 33 are spaced one another at a predetermined interval in the radial direction of the body 32. Each of the blades 33 has at its free end a cutting edge 34 extending throughout the length thereof. A heating element 35 is provided in the hollow cylindrical body 32 and heats the cutting edges 34 above a temperature at which the film F' starts melting. The blade 33 may be notched at longitudinal intervals so as to form a series of discrete cutting edges (not shown) extending longitudinally therealong.

Obviously, many modifications and variations of the present invention are possible in the light of the above teachings. It is therefore to be understood that within the scope of the appended claims, the invention may be practiced otherwise than as specifically described.

What is claimed is:

1. A method of slitting a continuous thermoplastic film, comprising the steps of:

(a) advancing the film longitudinally at a first speed along a peripheral surface of a roll rotating at a circumferential speed substantially equal to or slightly greater than said first speed, said peripheral surface comprising an elastic layer made of a polymeric material;

(b) slitting the film while being advanced by pressing, against said elastic surface layer, cutting edges of a cutter rotating at substantially the same speed as said roll;

(c) heating said cutting edges above a temperature at which the thermoplastic film starts melting; and (d) cooling the film and said elastic surface layer of said roll along their interface.

2. A method according to claim 1, said polymeric material comprising an elastomer.

3. A method according to claim 1, said polymeric material comprising leather.

4. A method according to claim 1, said polymeric material comprising resin-impregnated leather.

5. A method according to claim 1, said polymeric material comprising a fabric.

6. A method according to claim 1, said polymeric material comprising a resin-impregnated fabric.

7. A method according to claim 1, said heating step (c) comprising immersing said cutting edges in a bath of a hot silicone oil.

8. A method according to claim 1, said heating step (c) comprising providing said cutter with a heating element.

9. A method according to claim 1, said cooling step (d) comprising wetting said elastic surface layer with a cooling liquid.

10. A method according to claim 9, said cooling liquid comprising water.

11. An apparatus for slitting a continuous thermoplastic film, comprising:

(a) means for advancing the film longitudinally at a first speed;

(b) a roll rotatable at a circumferential speed substantially equal to or slightly greater than said first speed and having a peripheral surface along which the film is advanced, said peripheral surface comprising an elastic layer made of a polymeric material;

(c) a cutter disposed adjacent to said roll and rotatable at substantially the same speed as said roll, said cutter having cutting edges engageable with said elastic surface layer of said roll;

(d) means for heating said cutting edges above a temperature at which the thermoplastic film starts melting; and (e) means for cooling the contacting surface between the film and said elastic surface layer of said roll.

12. An apparatus according to claim 11, and polymeric material comprising an elastomer.

13. An apparatus according to claim 11, said polymeric material comprising leather.

14. An apparatus according to claim 11, said polymeric material comprising resin-impregnated leather.

15. An apparatus according to claim 11, said polymeric material comprising a fabric.

16. An apparatus according to claim 11, said polymeric material comprising a resin-impregnated fabric.

17. An apparatus according to claim 11, said cutter including a body rotatable about its own axis, and a plurality of circular cutting blades mounted on said body for corotation therewith and spaced one another at a predetermined interval in the axial direction of said body, the cutting edge of each blade extending continuously throughout the circumferential length of said blade.

18. An apparatus according to claim 11, said cutter including a body rotatable about its own axis, and a plurality of circular cutting blades mounted on said body for corotation therewith and spaced one another at a predetermined interval in the axial direction of said body, each blade having a plurality of discrete cutting edges each extending arcuately along the circumference of said blade at predetermined intervals.

19. An apparatus according to claim 11, said cutter including a body rotatable about its own axis, and a plurality of rectangular cutting blades mounted on said body for corotation therewith and spaced one another at a predetermined interval in the radial direction of said body, the cutting edge of each blade extending continuously throughout the length of said blade.

20. An apparatus according to claim 11, said cutter including a body rotatable about its own axis, and a plurality of rectangular cutting blades mounted on said body for corotation therewith and spaced one another at a predetermined interval in the radial direction of said body, each blade having a plurality of discrete cutting edges each extending longitudinally along said blade at predetermined intervals.

21. An apparatus according to claim 11, said heating means comprising a bath for a silicone oil into which said cutting edges are immersed as said cutter rotates, and a heating to maintain said temperature of said cutting edges.

22. An apparatus according to claim 21, including means for scraping said silicone oil off said cutting edges.

23. An apparatus according to claim 11, said heating means comprising a heating element associated with said cutter.

24. An apparatus according to claim 11, said cooling means comprising a bath for a cooling liquid in which said elastic surface layer is immersed as said roll rotates.

25. An apparatus according to claim 24, said cooling liquid comprising water.

26. A method according to claim 1, said cutting edges being continuous.

27. A method according to claim 1, said cutting edges being discrete and being separated by circumferential intervals.

* * * * *